United States Patent [19]

Focke et al.

[11] 4,293,068

[45] Oct. 6, 1981

[54] MULTI-LAYERED FOIL CIGARETTE PACK WITH STRIP SEALED TEAR FLAP

[75] Inventors: Heinz Focke; Kurt Liedtke, both of Verden, Fed. Rep. of Germany

[73] Assignee: Focke & Co., Verden, Fed. Rep. of Germany

[21] Appl. No.: 81,241

[22] Filed: Oct. 2, 1979

[30] Foreign Application Priority Data

Oct. 30, 1978 [DE] Fed. Rep. of Germany ..... 2847161

[51] Int. Cl.[3] ..... B65D 75/20; B65D 75/26; B65D 85/10

[52] U.S. Cl. ..... 206/264; 206/629; 206/630; 206/631

[58] Field of Search ..... 206/264, 604, 620, 628, 206/630, 624, 625, 629, 631, 632, 633; 229/7 R, 48 R, 87 C

[56] References Cited

U.S. PATENT DOCUMENTS

| | | | |
|---|---|---|---|
| 3,510,053 | 5/1970 | Focke | 206/264 |
| 3,580,466 | 5/1971 | Thelen | 206/628 |
| 3,620,438 | 11/1971 | Wood | 206/620 |
| 3,952,868 | 4/1976 | Muller | 229/87 C |

FOREIGN PATENT DOCUMENTS

| | | | |
|---|---|---|---|
| 158812 | 5/1940 | Fed. Rep. of Germany | 229/87 C |

*Primary Examiner*—Herbert F. Ross
*Attorney, Agent, or Firm*—Sughrue, Mion, Zinn, Macpeak and Seas

[57] ABSTRACT

An opening flap 22 in a cigarette pack formed by a bonded foil laminate including an aluminum layer 10 and a paper layer 11 is defined by a tear line 23 formed by discontinuous perforations 24 extending completely through the laminate. The tear line is overlaid by a cover strip 27 of adhesive to maintain an aroma and moisture-proof seal in the folded pack.

5 Claims, 4 Drawing Figures

MULTI-LAYERED FOIL CIGARETTE PACK WITH STRIP SEALED TEAR FLAP

BACKGROUND OF THE INVENTION

This invention relates to a multi-layered cigarette pack made of bonded foil, preferably an aluminum and paper laminate, and having an opening flap defined by a perforated or discontinuous tear line covered by a sealing strip.

Multi-layered foils, particularly bonded foils and conventional tin foils are widely used as packaging materials for food and other consumables which must be kept in a fresh condition after packaging. These materials are particularly suitable for the packaging of cigarettes, wherein the preservation of aroma and moisture are important considerations. Such packaging material is primarily used as an inner wrapper in cigarette packs, both for flip-top packs and soft packs. Cigarette packs folded from a single piece of bonded foil are also well known in the art.

One problem associated with producing cigarette packs of this type is that of providing a suitably economic foil material which is also capable of providing a satisfactory aroma barrier or seal. Another consideration is that of producing the packs by completely automated equipment which is capable of providing a tight and reliable seal with the packaging material employed. Finally, attention must be given to the need of the consumer to gain quick and relatively effortless access to the contents of the pack when desired.

In prior art cigarette packs made of a multi-layered bonded foil, an opening flap is typically defined by a tear line formed by a reduction in the thickness of the bonded foil. During the provision of this tear line several layers of the foil are penetrated, and only the outer plastic cover layer remains unaltered. This cover layer is then torn when opening the tear flap. This known arrangement is generally suitable for packaging foils having four or five bonded layers, but with foils having only two or three layers, such a reduction in thickness does not produce satisfactory results, and typically the aroma and moisture seal is imperfect or broken.

SUMMARY OF THE INVENTION

An object of this invention is thus to provide a cigarette pack made of a multi-layered bonded foil having only two or three layers, and which is provided with a reliable and airtight seal in the vicinity of an opening flap tear line and which can still be easily and quickly torn open.

According to this invention, a blank of multi-layered bonded foil from which a cigarette pack may be formed or folded is discontinuously perforated to define an opening flap tear line, and the perforations are then covered locally by a strip of sealing material which may be readily torn to facilitate the opening of the pack. The cover strip or sealing material is preferably a glue composition, such as a reactive hot adhesive or an adhesive dispersion which overlays and follows the contours of the perforated tear line. The breaks in the perforations of the tear line leave small connecting points intact between the adjacent areas of the foil material to thus enhance the overall strength of the pack and preclude its inadvertant or unintentional rupture along the tear line.

The invention is particularly advantageous in the processing of a two-layered bonded laminate of aluminum foil and paper into cigarette packs, such material having been widely known for many years and being especially economical when used as the inner wrapper for cigarette groups within a pack. According to the invention, such material may now be used to provide a hermetically sealed inner wrapper having overlapping seam flaps along the sides and around the top of the pack which are sealed by glue strips or the like. Such glue strips and the cover strips overlying the perforated tear line are provided on the paper side of the bonded foil, and lie on the inside of the wrapper after the appropriate folding and sealing operations are performed.

Such relatively thin two-layered packaging material can obviously be easily handled by an automatic packaging apparatus wherein a continuous strip of the material is first perforated by a punch apparatus to define the desired tear line, and is thereafter fed to a gluing station where a cover strip pattern of adhesive is applied in a continuous operation to overlie the tear line (s) and simultaneously define the necessary sealing seams.

DETAILED DESCRIPTION OF THE PREFERRED EMBODIMENT

Figure 1:
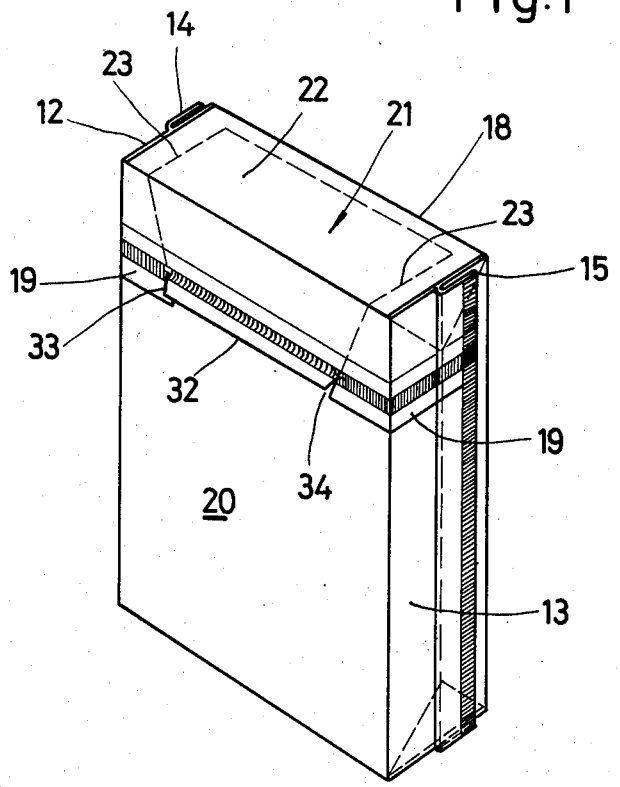
FIG. 1 shows a perspective view of a cigarette pack made of a hermetically sealed bonded foil wrapper having a tear-open flap according to the present invention.
Figure 2:
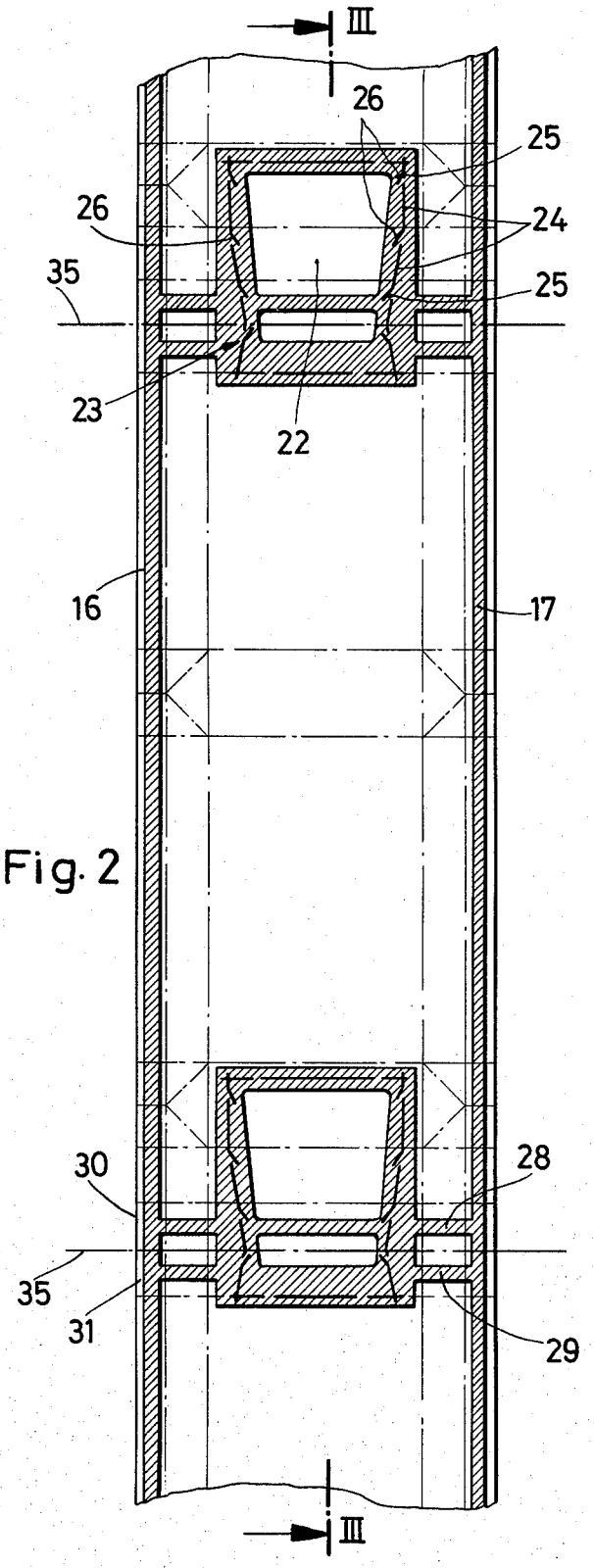
FIG. 2 shows a plan view of a continuous strip of bonded foil packaging material after perforation and glue strip application.
Figure 3:
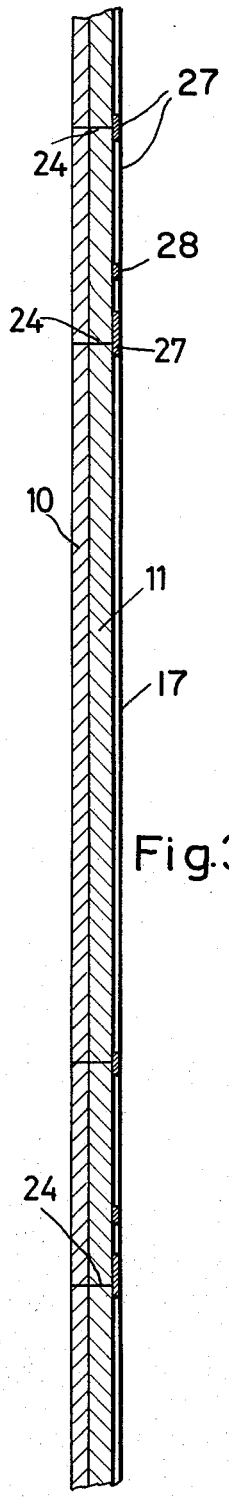
FIG. 3 shows a longitudinal section through the continuous strip of FIG. 2.
Figure 4:
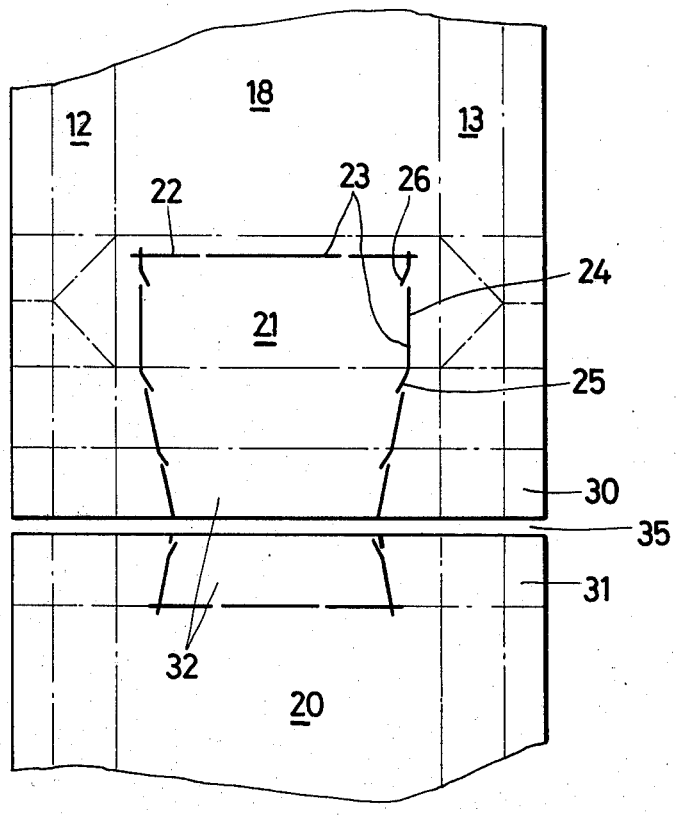
FIG. 4 shows an enlarged view of two mutually confronting edges of adjacent wrapper blanks after separation.

Referring now to the drawings, the wrapped cigarette pack shown in the perspective view of FIG. 1 is formed from a bonded foil blank as shown in FIGS. 2–4 having an outside aluminum layer 10 and an inner layer 11 of paper. The foil pack of FIG. 1 is heremetically sealed along the narrow sides 12 and 13 of the pack by overlapping finned or corrugated seams as shown in FIG. 1. To implement this, the bonded foil blank is wrapped around the cigarette group such that glue strips 16 and 17 along the side edges of the blank (FIG. 2) come together on the side surfaces 14 and 15 of the pack to form initially outstanding fins, which are subsequently folded flat against the sides of the pack. The back or rear side 18 of the pack remains seamless, and a finned tube seam 19 is formed on the upper front side 20 of the pack by the joined longitudinal ends of the blank to thus complete the seal.

An opening flap 22 is formed in the upper front side 20 and the adjacent topside 21 of the pack, and this flap has a rectangular area at the top adjoined by an adjacent trapezoidal area which progressively decreases in width towards the tab edge of the flap. The top rectantular area of the opening flap is slightly smaller than the upper surface of the pack.

The opening flap 22 is defined by a tear line 23 formed by discontinuously perforating or penetrating the bonded double-layered foil. Each perforation 24 lies along the contour of the overall tear line 23 with spaced connecting points 25 remaining between the perforations. These connecting points extend between the opening flap 22 and the adjacent portions of the wrapper blank, and increase the structural integrity of the resulting pack. The connecting points are defined by angled cuts 26 which lie in a direction opposite to that of the tear direction when the flap is opened.

The perforations 24 of the tear line are provided with a local cover layer or band 27 applied in a predetermined pattern as shown in FIGS. 2–3, which layer comprises a rupturable or tearable coating of adhesive. After the perforations 24 have been made and the cover layer 27 has been subsequently applied by an appropriately configured glue roller, the individual wrapper blanks are separated from the continuous web or strip along severing lines 35 as shown in FIG. 2.

Simultaneously with the application of the cover layer 27, the complete glue or adhesive pattern is applied including the longitudinal strips 16, 17 to ultimately form the side fins 14, 15 and the horizontal strips 28, 29 which form the tube seam 19. The perforations and localized glue pattern application are implemented in a continuous manner at sequential stages or working stations of the packaging machine.

After a group of cigarettes has been wrapped in a blank, the edge strips 30, 31 which form the tube seam 19 abut each other, and in this area the leading or tab edge of the opening flap 22 is thus double layered. This tab edge 32 is separated from the body of the pack by starting cuts 33, 34 at its sides, and thus serves as a finger pinch grip by means of which the tearing of the opening flap 22 may be initiated.

As will be obvious to those skilled in this art, the invention is not restricted to a cigarette pack made of a bonded multilayered foil, but is equally applicable to a single-layer foil perforated and overlayed with an appropriate adhesive pattern as disclosed above.

I claim:

1. A cigarette pack, comprising:

(a) a rectangular container folded from a laminated blank including an outer layer (10) of metal foil and an inner layer (11) of paper bonded thereto, (b) an opening flap (22) disposed on adjoining top and upper front surfaces of the container, said flap being defined by a tear line (23) formed by aligned but discontinuous perforations (24) extending completely through the metal foil and paper layers, and (c) a localized band-like layer (27) of aroma and moisture-proof, severable adhesive material bonded to the interior surface of said paper layer, overlying and straddling the tear line, and extending laterally outwardly therefrom to a limited degree on the interior of the container, whereby said opening flap may be torn off from the container to gain access to the contents thereof.

2. A pack according to claim 1, wherein the metal foil is aluminum and spaced connecting points (25) bridge the gaps between adjacent perforations.

3. A pack according to claim 2, wherein the localized layer of adhesive material is adjoined by additional seam sealing adhesive material strips (16, 17; 28, 29) to form a unified adhesive material pattern on the paper layer side of the laminated blank.

4. A pack according to claim 2, wherein the connecting points (25) are defined by angled perforations (26) oriented in a direction opposite to the tear direction.

5. A pack according to claim 4, wherein the opening flap has an unattached edge on the upper front surface of the container which serves as a grip tab (32), said grip tab being formed by overlapping edge strips (30, 31) of the laminated blank on the front surface of the container.

* * * * *